US007055979B2

(12) United States Patent
Lee

(10) Patent No.: US 7,055,979 B2
(45) Date of Patent: Jun. 6, 2006

(54) LANTERN DETACHABLE CAP

(75) Inventor: Woo Soo Lee, Seoul (KR)

(73) Assignee: Best Cap, Seoul (KR)

( * ) Notice: Subject to any disclaimer, the term of this patent is extended or adjusted under 35 U.S.C. 154(b) by 9 days.

(21) Appl. No.: 10/774,764

(22) Filed: Feb. 9, 2004

(65) Prior Publication Data

US 2005/0174752 A1 Aug. 11, 2005

(51) Int. Cl.
*F21L 4/00* (2006.01)

(52) U.S. Cl. ..... 362/105; 362/106; 362/190; 362/191; 362/285

(58) Field of Classification Search ..... 362/190, 362/191, 285, 105, 106, 188
See application file for complete search history.

(56) References Cited

U.S. PATENT DOCUMENTS 6,206,543 B1 * 3/2001 Henry ..... 362/191
2005/0047124 A1 * 3/2005 Hsien ..... 362/188

* cited by examiner

*Primary Examiner*—Sandra O'Shea
*Assistant Examiner*—Anabel Ton
(74) *Attorney, Agent, or Firm*—Levine & Mandelbaum

(57) ABSTRACT

In a lantern detachable cap, a clip part having a shape of circle is provided at a lower end of the extension portion formed at the connecting portion of the moving manipulate member, and a lantern is attached to and detached from the clip, the lantern has a shape of cylinder, a battery is loaded within the lantern, and an on/off switch is protruded from one side of the lantern. In addition, the clip part may comprise a pair of clips and be formed at the lower end of the extension portion of the moving manipulate member. According to the lantern detachable cap, since the lantern detachable cap has a clip part at a lower portion of a connecting portion of a moving manipulate member and a lantern attached to and detached from the clip part, the lantern can be freely attached and detached. In addition, since the detaching/attaching mechanisms of the lantern are simplified, production cost can be reduced. Moreover, since the lantern is attached to and detached from only a peak of the cap, the cap can be neatly shaped.

7 Claims, 5 Drawing Sheets

LANTERN DETACHABLE CAP

BACKGROUND OF THE INVENTION

1. Field of the Invention

The present invention relates to a lantern detachable cap, and more particularly, a lantern detachable cap of which a lantern is freely detachable from a peak of the cap.

2. Description of the Related Art

In general, someone grips a lantern with his hand(s) to light up the front or surroundings when he is going hiking and fishing or doing a job at night. In some cases, he may be tumbled over a stone or intend to pull a fishing rod abruptly. At this time, if he grips the lantern with his hand(s), he can not rapidly cope with the abrupt situation. In addition, he can not be effectively doing a job with his hand(s) griping the lantern.

Therefore, in order to solve the problem and provide convenience, a lantern attached cap has been developed. For example, proposed and developed are various caps in the Korean Utility Model Application No. 02-16247 entitled, "a light-bulb attached cap," the Korean Utility Model Application No. 96-35598 entitled, "a light-lamp attached cap," the Korean Utility Model Application No. 90-8088 entitled, "a light-lamp attached fishing cap," the Korean Utility Model Application No. 03-15065 entitled, "a light-bulb cap," and the Korean Utility Model Application No. 01-33244 entitled, "a light-lamp attached peak for use in a cap."

Each of the aforementioned utility models has a complicated construction. In addition, a battery is separately provided at one side of the cap or the peak thereof. Therefore, an additional manipulation is inconveniently needed to turn on the lantern. Since the lantern is typically provided to outside of the peak, the cap can not be neatly shaped. Since the lantern is "fixed" on the peak, it is impossible to freely detach the lantern from the cap.

SUMMARY OF THE INVENTION

In order to solve the aforementioned problems, an object of the present invention is to provide a lantern detachable cap capable of freely detaching a lantern, having a simple structure, and reducing production costs.

In order to achieve the object, according to an aspect of the present invention, there is provided a lantern detachable cap comprising: a fixing member fixed to a peak of the cap; a moving manipulate member having a body, an extension portion, and connecting portion, the moving manipulate member being connected to and moved along the fixing member; and a pressing member being connected to the moving manipulate member and controlling the manipulate member, wherein a clip part having a shape of circle is provided at a lower end of the extension portion formed at the connecting portion of the moving manipulate member, and wherein a lantern is attached to and detached from the clip, the lantern has a shape of cylinder, a battery is loaded within the lantern, an on/off switch being protruded from one side of the lantern.

In addition, in the lantern detachable cap according to the aspect of the present invention, it is preferable that the clip part comprises a pair of clips and is formed at the lower end of the extension portion of the moving manipulate member.

In addition, in the lantern detachable cap according to the aspect of the present invention, the clip part comprises a single clip and is formed at the lower end of the extension portion of the moving manipulate member.

According to a lantern detachable cap of the present invention, since the lantern detachable cap has a clip part at a lower portion of a connecting portion of a moving manipulate member and a lantern attached to and detached from the clip part, the lantern can be freely attached and detached. In addition, since the detaching/attaching mechanisms of the lantern are simplified, production cost can be reduced. Moreover, since the lantern is attached to and detached from only a peak of the cap, the cap can be neatly shaped.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENT OF THE INVENTION

Figure 1:
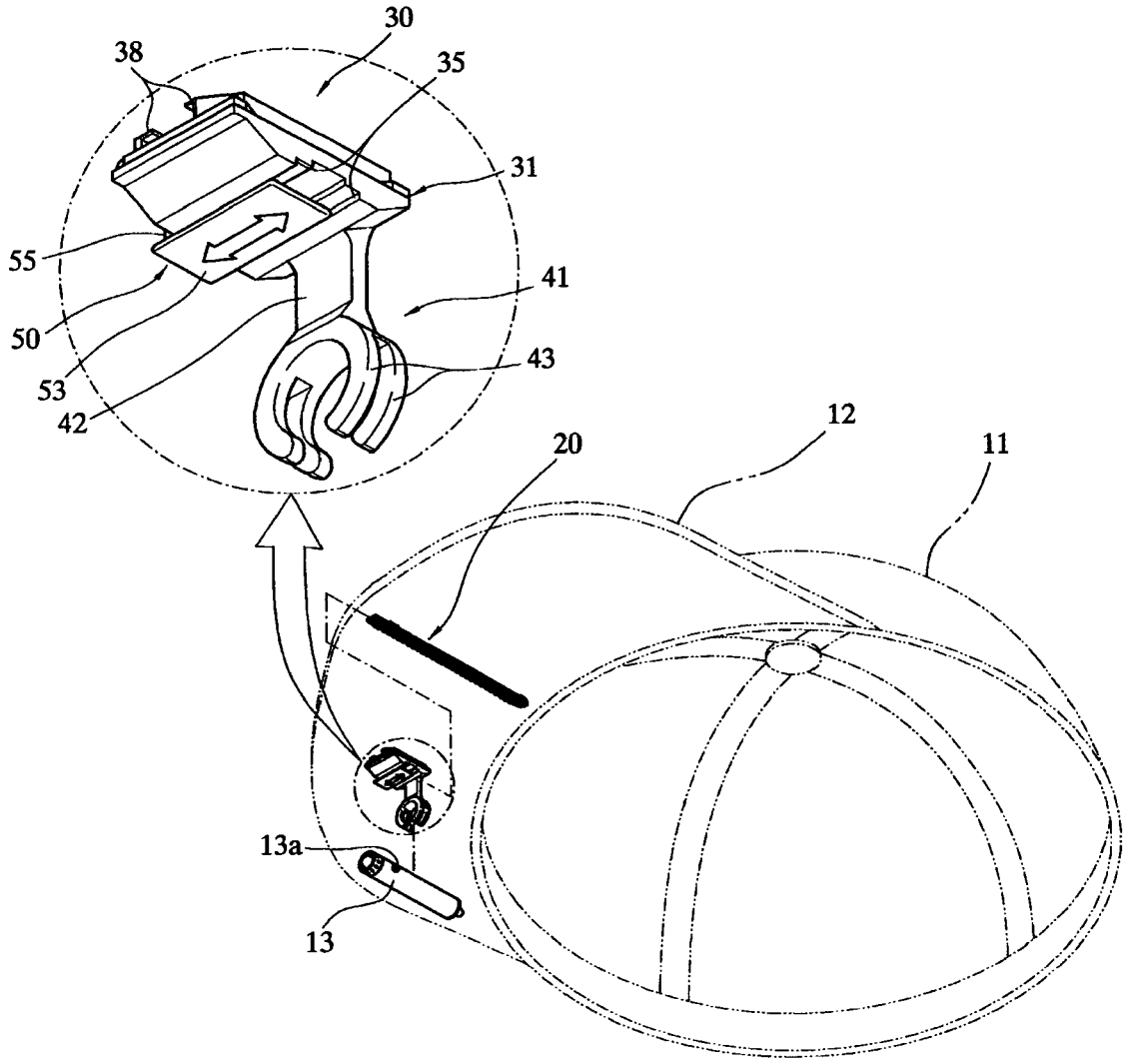
FIG. 1 is an exploded perspective view illustrating a lantern detachable cap according to an embodiment of the present invention.

The present invention and operational advantages thereof can be fully understood by referring to the accompanying drawings and explanations thereof.

Now, the exemplary embodiments of the present invention will be described with reference to the accompanying drawings to explain the present invention in detail. In the drawings, the same reference numerals indicate the same elements.

Figure 2:
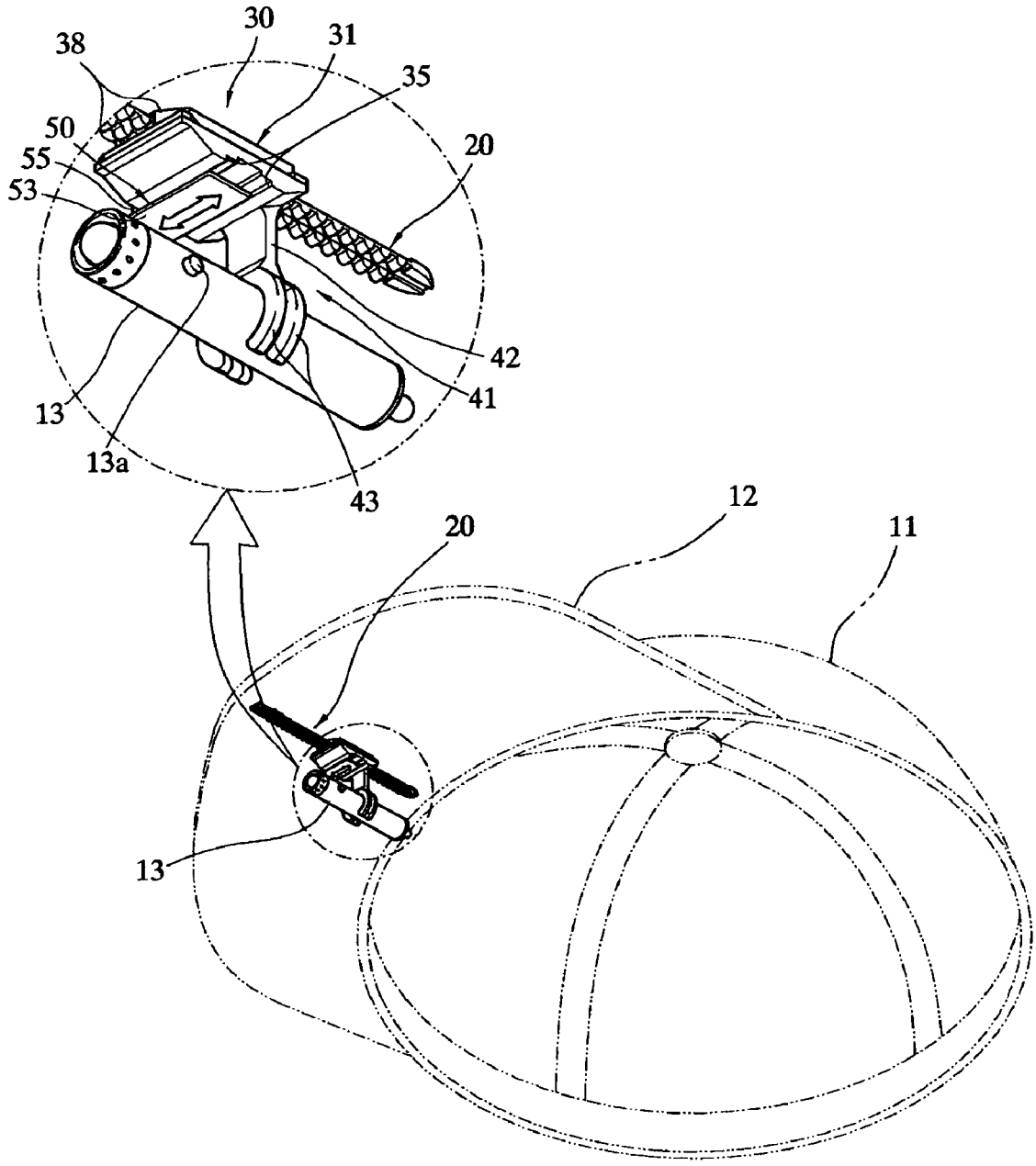
FIG. 2 is an assembled perspective view illustrating a lantern detachable cap according to an embodiment of the present invention.
Figure 3:
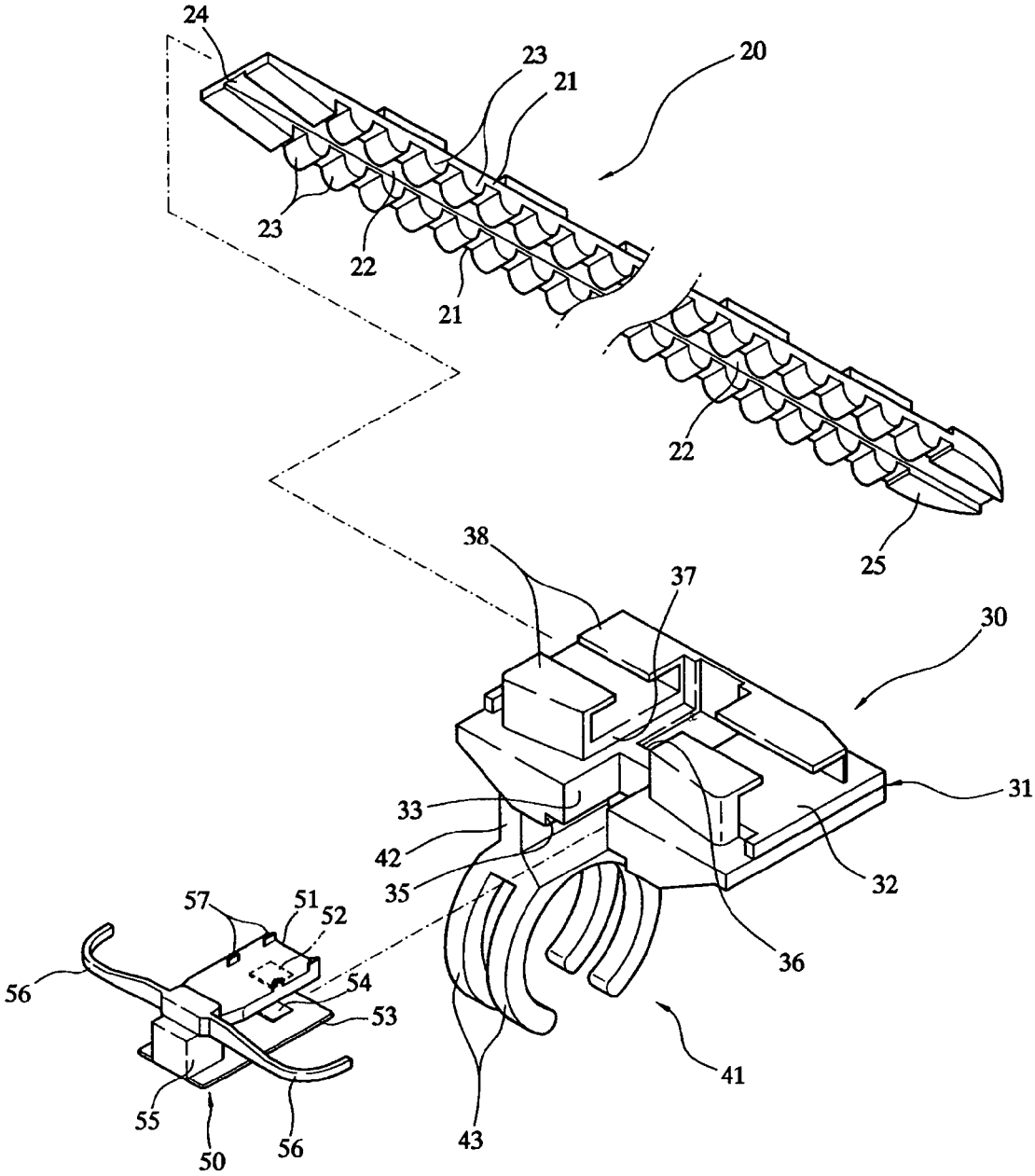
FIG. 3 is a partial exploded perspective view illustrating main parts of a lantern detachable cap according to an embodiment of the present invention.
Figure 4:
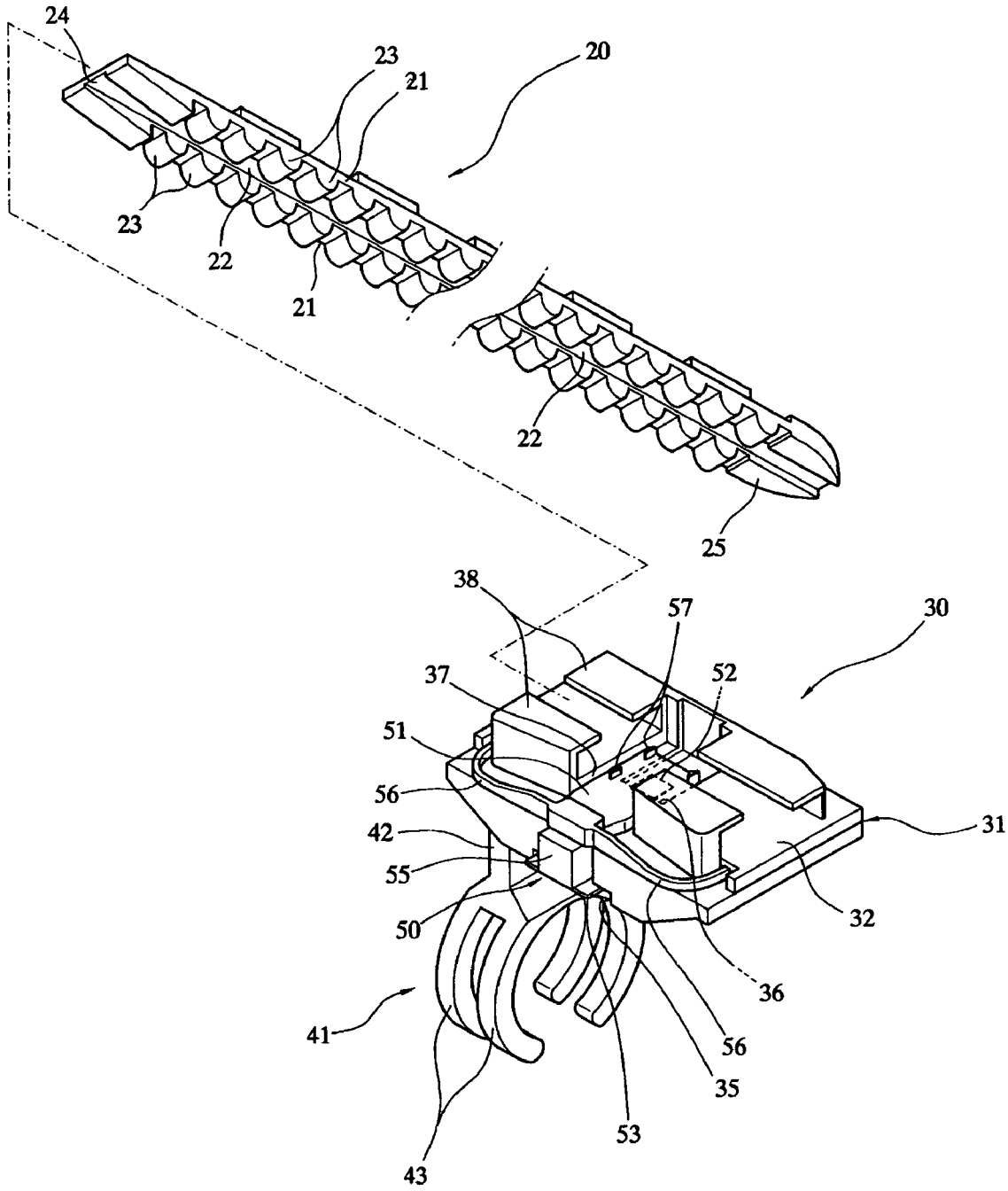
FIG. 4 is a partial assembled perspective view illustrating main parts of a lantern detachable cap according to an embodiment of the present invention.

FIGS. 1 and 2 are exploded and assembled perspective views illustrating a lantern detachable cap according to an embodiment of the present invention, respectively. FIGS. 3 and 4 are partial exploded and assembled perspective views illustrating main parts of the lantern detachable cap according to the embodiment of the present invention, respectively. The lantern detachable cap 11 comprises a fixing member 20 hereinafter sometimes referred to as a holder, a moving manipulate member 30 hereinafter sometimes referred to as a carrier, and a lantern 30. The holder 20 is fixed on a peak 12 of the lantern detachable cap 11. The carrier 30 is connected to and moved along the holder 20. The lantern 13 is attached to and detached from the carrier 30.

The holder 20 is fixed on a central portion of a back surface of the peak 12. The holder 20 has a guide trench 22 and two guide rails 21. The guide trench 22 is formed at a central line of the holder 20 along a longitudinal direction thereof The two guide rails 21 are formed at both sides of the guide trench 22 along the longitudinal direction thereof.

In addition, a plurality of upper engaging protrusions 23 are disposed in an equal interval. Engaging protrusions 57 of a pressing member 50, described later, are selectively engaged with the upper engaging protrusions 23. At the one end of the holder 20 there is provided an entrance portion 24. At the other end of the holder 20 there is provided a blocking portion 25.

The carrier 30 comprises a body 31 and a connecting part 41.

A cut recess portion 33 is formed at a central portion of one side of a base 32 of the carrier 30. A lower fixing notch 34 is formed at a bottom surface of the base 32 at an inner side of the cut recess portion 33. Two lower guide notches 35 are formed at both sides of the lower fixing notch 34.

An upper fixing notch 36 is formed at a top surface of the base 32 at the inner side of the cut recess portion 33. Guide members 38 are provided at an upper portion of the base 32 of the body 31 and are guided by the two guide rails 21.

The connecting part 41 comprises an extension portion 41 and a clip part 43. The extension portion is extended downward from one side of the base 32 of the body 31. The clip part 43 is characteristically provided at a lower end of the extension portion 42 according to the present invention. The clip part 43 is formed at the lower end of the extension portion 41 and comprises a pair of circular clips.

The aforementioned pressing member 50 comprises first, second, and third parts 51, and two elastic pieces 56. The first part 51 is connected to the carrier 30 by being inserted along the upper guide notch 37 of the body 31. The first part 51 has an upper fixing protrusion 52 at the inner side thereof.

The second part 53 is connected to the carrier 30 by being inserted along the lower guide notch 35 of the body 31. The first part 52 has a lower fixing protrusion 54 at the inner side thereof.

The third part 55 are integrated with one side ends of the first and second parts 51 and 53, The third part 55 is attached to or detached from the cut recess portion 33 of the base 32.

The two elastic pieces 56 are longitudinally extended from the third part 55. The two elastic pieces 56 have a function of elastically pushing the second and third parts into the cut recess portion 33.

When the pressing member 50 is connected to the carrier 30, the upper fixing protrusion 52 of the first part 51 is engaged with the upper fixing notch 36 of the carrier 30, and the lower fixing protrusion 54 of the second part 24 is engaged with the lower fixing notch 34 of the carrier 30. In this condition, a central portion between the two elastic pieces 56 is pressed. As a result, the elastic pieces of the pressing member 50 are subjected to elastic deformation, and both sides of the pressing member 50 are guided along the upper and lower guide notches 37 and 35 of the carrier 30.

On the other hand, a plurality of engaging protrusions 57 are disposed at equal intervals on an outer surface of the first part 51. When the pressing member 50 is connected to the carrier 50 and pressed into the inner side of the carrier 50, the engaging protrusions 57 are located at the guide trench 22 and one side of the guide rails of the holder 20. If external force exerted on the pressing member 50 is released and the two elastic pieces are restored, the engaging protrusions 37 are interposed between the upper engaging protrusions of the holder 20.

The lantern 13 has a shape of cylinder. A battery is loaded within the lantern 13. An on/off switch protrudes from one side of the lantern. According to the present invention, the lantern 13 is detachably connected to the clip part 43, which is formed at the lower end of the extension portion 42 of the connecting portion 41 of the carrier 30.

In the lantern detachable cap of the present invention, when the carrier 30 and the pressing member 50 are separated from each other as shown FIG. 3, the pressing member 50 is pushed and inserted into the carrier 30.

As a result, while the pressing member 50 is elastically connected to the external side of the carrier 30 by means of the elastic pieces of the pressing member 50, the upper fixing protrusions 52 of the pressing member 50 are elastically connected to the upper fixing notch 36 of the carrier 30, and the lower fixing protrusions 55 of the pressing member 50 are elastically connected to the upper fixing notch 334 of the carrier 30.

In this way, when the carrier 30 and the pressing member 50 are connected to each other, the lantern 30 is pushed and inserted into the clip part 43 at the lower end of the extension portion 42 formed on the connecting portion 41 of the carrier 30, so that the lantern 13 can be elastically connected to the clip part 43.

In this state, the carrier 30 is connected to the holder 20. While the pressing member is pressed, both guide members 38 of the carrier 30 are aligned with both guide rails 21 of the holder 20 as shown in FIG. 4. Then, the guide rails 21 are pushed and inserted into the insides of the guide members 38.

In the lantern detachable cap having such aforementioned connection structure according to the present invention, a user of the cap can suitably manipulate a distance between the lantern and his face and hold the manipulated state by using the pressing member 50.

Since the lantern detachable cap 11 has the clip part 43 at the lower end of the connecting portion 41 of the carrier 30 and the lantern 13 attached to and detached from the clip part 43, the lantern 13 can be freely attached and detached. In addition, since the detaching/attaching mechanisms of the lantern 13 are simplified, production cost can be reduced. Moreover, since the lantern 13 is attached to and detached from only the peak 12 of the cap 11, the cap can be neatly shaped.

In day-time, since the lantern 13 is not needed, the lantern 13 of the lantern detachable cap 11 can be simply separated from the clip part 43 of the connecting portion 41 of the carrier 30 and carried within a bag or pocket. At night, the user elastically connects the lantern 13 to the clip 43 to have a bright front view. Therefore, the lantern can be practically used when the user is going hiking, climbing, fishing, doing a job, or in activities at night.

Figure 5:
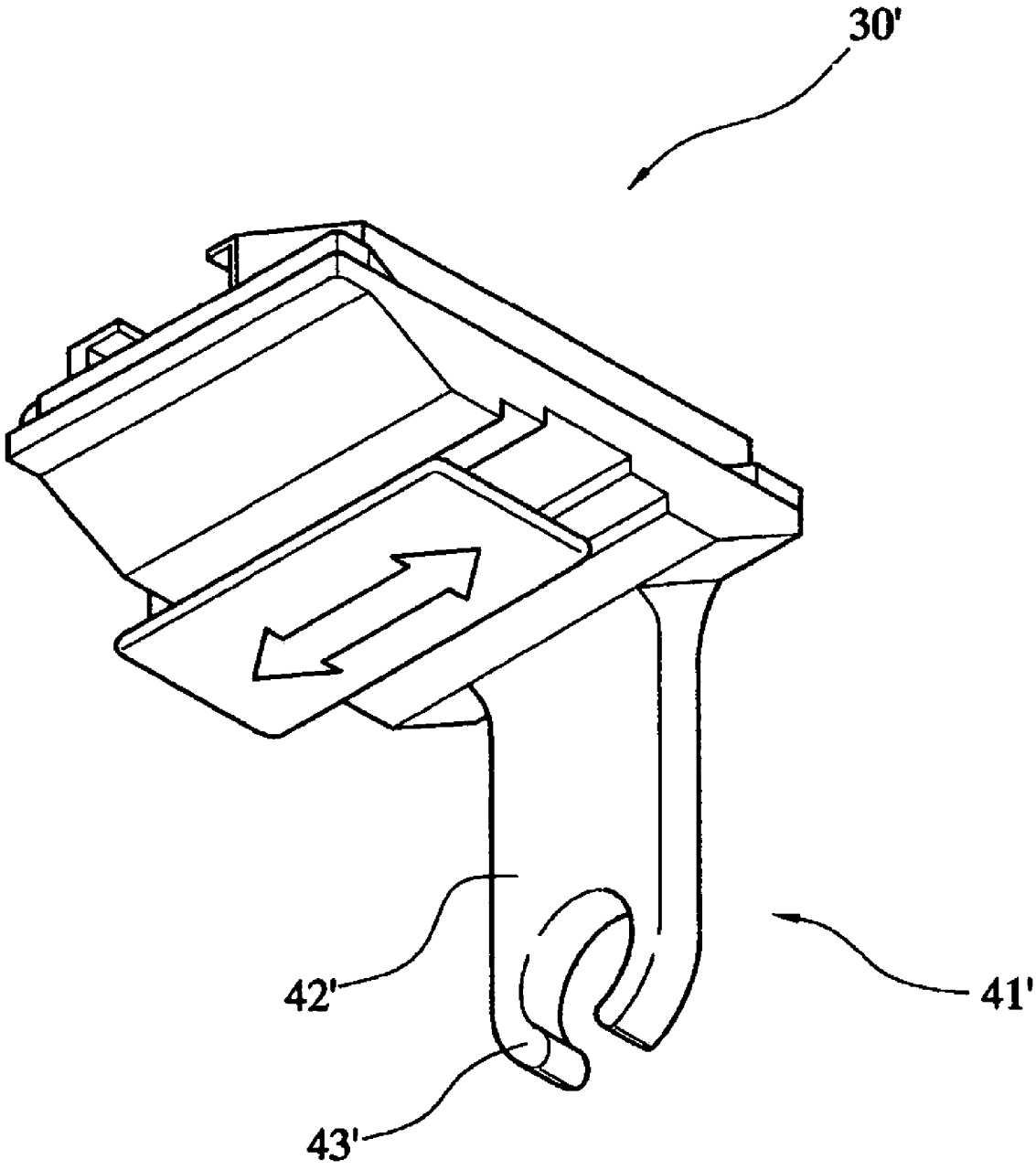
FIG. 5 is a partial perspective view illustrating a main part of a lantern detachable cap according to another embodiment of the present invention.

FIG. 5 is a partial perspective view illustrating a main part of a lantern detachable cap according to another embodiment of the present invention. In the embodiment, the clip part 43' has a single clip formed at a lower end of an extension portion 42' of a connecting portion 41' of a moving manipulate 30'.

According to a lantern detachable cap of the present invention, since the lantern detachable cap 11 has a clip part 43 (43') at a lower portion of a connecting portion 41 (41') of a carrier 30 (30') and a lantern 13 attached to and detached from the clip part 43 (43'), the lantern 13 can be freely attached and detached. In addition, since the detaching/attaching mechanisms of the lantern 13 are simplified, production cost can be reduced. Moreover, since the lantern 13 is attached to and detached from only a peak 12 of the cap 11, the cap can be neatly shaped.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A lantern detachable cap comprising:

a holder fixed to a peak of the cap, a carrier having a body, an extension portion, and a connecting portion, the carrier being connected to and translatable along the holder, a pressing member connected to the carrier, and a clip part having a shape of a circle mounted on a lower end of the extension portion formed at the connecting portion of the carrier, wherein a lantern having a shape of cylinder can be attached to and detached from the clip with its on/off switch is protruding from one side of the lantern.

2. A lantern detachable cap according to claim 1, wherein the clip part comprises a pair of clips formed at the lower end of the extension portion of the carrier.

3. A lantern detachable cap according to claim 1, wherein the clip part comprises a single clip formed at the lower end of the extension portion of the carrier.

4. A lantern detachable cap according to claim 1, wherein the holder has a first fastener means disposed along an axis, the carrier is slidably mountable on said holder for linear movement along said axis, said carrier having second fastener means for engaging said first fastener means, said pressing means comprises latching means operatively mountable between said holder and said carrier, said carrier being adapted to be actuated between a normally locked state during which said second fastener means is in axial alignment with said first fastener means for preventing movement of said carrier along the length of said holder, and a released state during which said second fastener means is laterally displaced from the axis of said first fastener means for permitting movement of said carrier along the length of said holder, said pressing member having a surface adapted to receive manual pressure for moving said latching means from said normally locked state to said released state, and resilient means for urging said latching means toward said normally locked state in the absence of manual pressure on said surface.

5. Apparatus according to claim 1 wherein said holder comprises spaced teeth and said latching means has at least one projection adapted to be selectively positioned between said teeth for locking said carrier with respect to said holder.

6. Apparatus according to claim 5 wherein said resilient means comprises bias means operatively engageable with said second fastening means f or urging said latching means to said locked state in the absence of external pressure, and for urging said latching means to said released state in the presence of external pressure.

7. Apparatus according to claim 6 wherein said urging means comprises a spring exerting a force in one direction, and said surface is adapted to be manually pressed for applying said external force in a direction opposite to the direction of force of said spring.

* * * * *